US009467780B2

(12) United States Patent
Kelly et al.

(10) Patent No.: US 9,467,780 B2
(45) Date of Patent: Oct. 11, 2016

(54) DJ MIXING HEADPHONES

(75) Inventors: Peter M. Kelly, Park City, UT (US); Richard P. Alden, Park City, UT (US); Daniel Levine, Newport Beach, CA (US); Joshua B. Poulsen, Salt Lake City, UT (US)

(73) Assignee: Skullcandy, Inc., Park City, UT (US)

( * ) Notice: Subject to any disclaimer, the term of this patent is extended or adjusted under 35 U.S.C. 154(b) by 75 days.

(21) Appl. No.: 13/060,256

(22) PCT Filed: Jan. 6, 2011

(86) PCT No.: PCT/US2011/020368

§ 371 (c)(1),
(2), (4) Date: Feb. 22, 2011

(87) PCT Pub. No.: WO2011/085096

PCT Pub. Date: Jul. 14, 2011

(65) Prior Publication Data

US 2012/0275615 A1 Nov. 1, 2012

Related U.S. Application Data

(63) Continuation-in-part of application No. 29/366,268, filed on Jul. 22, 2010, now Pat. No. Des. 641,003.

(60) Provisional application No. 61/292,832, filed on Jan. 6, 2010.

(51) Int. Cl.

| | |
|---|---|
| ***H04R 5/04*** | (2006.01) |
| ***H04R 1/10*** | (2006.01) |
| ***H04R 5/033*** | (2006.01) |

(52) U.S. Cl.

CPC ..... *H04R 5/04* (2013.01); *H04R 1/1041* (2013.01); *H04R 1/1066* (2013.01); *H04R 5/033* (2013.01); *H04R 2420/01* (2013.01); *H04R 2420/03* (2013.01)

(58) Field of Classification Search

CPC .. H04R 1/1075; H04R 1/1058; H04R 1/105; H04R 1/1041; H04R 5/0335; H04R 5/033; H04R 5/04; H04R 2420/03; H04R 2420/01; H04R 1/1066

USPC ..... 381/74, 309–311, 77, 80, 81, 85, 119, 381/387, 383, 374

See application file for complete search history.

(56) References Cited

U.S. PATENT DOCUMENTS

| | | | |
|---|---|---|---|
| 2,437,049 | A | 3/1948 | Salisbury et al. |
| 2,812,517 | A | 11/1957 | Bogart et al. |

(Continued)

FOREIGN PATENT DOCUMENTS

| | | | |
|---|---|---|---|
| CA | 2515558 | A1 | 2/2007 |
| CA | 2697029 | A1 | 2/2007 |

(Continued)

OTHER PUBLICATIONS

Machine translation of JP 2002-111416A, Apr. 12, 2002, 4 pages.*

(Continued)

*Primary Examiner* — Ping Lee

(74) *Attorney, Agent, or Firm* — TraskBritt

(57) ABSTRACT

A set of headphones designed to be used by DJ's for the purpose of mixing two or more music tracks being played from two or more audio playing devices. The headphones are configured such that a DJ can easily mute one headphone speaker so that the DJ can listen to a first music track that is being played through a sound system. At the same time, the headphones are configured to direct the complete stereo signal to the other headphone speaker so that the DJ can listen to the complete audio from a second music track. For example, when the DJ presses an audio control button, the set of headphones can automatically mute one of the speakers on the headphones, and automatically direct all of the stereo channels to the opposing speaker on the set of headphones.

12 Claims, 7 Drawing Sheets

(56) References Cited

U.S. PATENT DOCUMENTS

| | | | | |
|---|---|---|---|---|
| 3,327,807 | A | 6/1967 | Mullin | |
| 3,579,640 | A | 5/1971 | Beguin et al. | |
| 4,243,851 | A | 1/1981 | Forney | |
| 4,829,571 | A * | 5/1989 | Kakiuchi et al. | 381/309 |
| D379,028 | S | 5/1997 | Young | |
| 5,697,386 | A | 12/1997 | Chang | |
| 5,987,647 | A | 11/1999 | Ouellette | |
| 6,118,882 | A * | 9/2000 | Haynes | 381/374 |
| 6,542,615 | B1 * | 4/2003 | Ito | 381/374 |
| 6,584,984 | B2 | 7/2003 | Kelly | |
| 7,187,948 | B2 | 3/2007 | Alden | |
| 7,395,090 | B2 | 7/2008 | Alden | |
| D575,268 | S | 8/2008 | Christopher et al. | |
| 7,457,649 | B1 * | 11/2008 | Wilson | 381/374 |
| D588,100 | S | 3/2009 | Densho et al. | |
| D617,308 | S | 6/2010 | Nousiainen et al. | |
| D623,627 | S | 9/2010 | Alden et al. | |
| D624,057 | S | 9/2010 | Kelly et al. | |
| D628,554 | S | 12/2010 | Tedja | |
| D633,471 | S | 3/2011 | Sugiyama | |
| D641,003 | S | 7/2011 | Alden | |
| 8,014,824 | B2 | 9/2011 | Alden | |
| D650,356 | S | 12/2011 | Alden et al. | |
| D656,129 | S | 3/2012 | Kelly et al. | |
| D665,776 | S | 8/2012 | Alden et al. | |
| D665,777 | S | 8/2012 | Alden et al. | |
| D673,136 | S | 12/2012 | Kelly et al. | |
| D673,140 | S | 12/2012 | Kelly et al. | |
| D674,372 | S | 1/2013 | Kelly et al. | |
| D674,376 | S | 1/2013 | Kelly et al. | |
| D676,023 | S | 2/2013 | Kelly et al. | |
| D676,024 | S | 2/2013 | Kelly et al. | |
| D677,241 | S | 3/2013 | Kelly et al. | |
| D683,717 | S | 6/2013 | Kelly et al. | |
| 8,457,557 | B2 | 6/2013 | Alden | |
| D685,759 | S | 7/2013 | Kelly et al. | |
| D685,767 | S | 7/2013 | Kelly et al. | |
| 8,515,115 | B2 | 8/2013 | Kelly et al. | |
| D689,464 | S | 9/2013 | Bonahoom et al. | |
| 8,542,859 | B2 | 9/2013 | Alden | |
| D691,582 | S | 10/2013 | Nguyen et al. | |
| D693,793 | S | 11/2013 | Kelly et al. | |
| D699,216 | S | 2/2014 | Bonahoom et al. | |
| D701,193 | S | 3/2014 | Kelly et al. | |
| D701,196 | S | 3/2014 | Kelly et al. | |
| D701,197 | S | 3/2014 | Kelly et al. | |
| D707,654 | S | 6/2014 | Nguyen et al. | |
| 2006/0045304 | A1 | 3/2006 | Lee et al. | |
| 2007/0291949 | A1 * | 12/2007 | Imaki | 381/17 |
| 2008/0130924 | A1 * | 6/2008 | Vaudrey et al. | 381/311 |
| 2008/0175403 | A1 * | 7/2008 | Tan et al. | 381/77 |
| 2008/0298578 | A1 * | 12/2008 | Regen et al. | 379/430 |
| 2009/0041267 | A1 * | 2/2009 | Lee | H04R 5/033 381/104 |
| 2011/0144779 | A1 | 6/2011 | Janse et al. | |
| 2012/0275615 | A1 | 11/2012 | Kelly et al. | |
| 2013/0118944 | A1 | 5/2013 | Niiro et al. | |
| 2013/0130540 | A1 | 5/2013 | Oman et al. | |
| 2013/0177165 | A1 | 7/2013 | Oishi | |
| 2013/0177195 | A1 | 7/2013 | Sze et al. | |
| 2013/0185905 | A1 | 7/2013 | Stiff et al. | |
| 2013/0208909 | A1 | 8/2013 | Mülder | |
| 2013/0336514 | A1 | 12/2013 | Kelly et al. | |
| 2014/0056459 | A1 | 2/2014 | Oishi et al. | |
| 2014/0270228 | A1 | 9/2014 | Oishi et al. | |
| 2014/0270230 | A1 | 9/2014 | Oishi et al. | |

FOREIGN PATENT DOCUMENTS

| | | | |
|---|---|---|---|
| CN | 1719426 | A | 1/2006 |
| CN | 2772163 | Y | 4/2006 |
| CN | 200976669 | Y | 11/2007 |
| EM | 001548132-0001 | | 6/2009 |
| EM | 001665068-0001 | | 2/2010 |
| EP | 1742352 | A2 | 1/2007 |
| EP | 1760896 | A1 | 3/2007 |
| EP | 2262117 | A1 | 12/2010 |
| JP | 58-28986 | U | 2/1983 |
| JP | 10155191 | A | 6/1998 |
| JP | 10191491 | A | 7/1998 |
| JP | 3064856 | U | 1/2000 |
| JP | 2001520831 | A | 10/2001 |
| JP | 2002111416 | A | 4/2002 |
| JP | 2005094603 | A | 4/2005 |
| JP | 2008042709 | A | 2/2008 |
| JP | 2008131439 | A | 6/2008 |
| JP | 2008289101 | A | 11/2008 |
| JP | 2009530950 | | 8/2009 |
| KR | 200372720 | Y1 | 1/2005 |
| SG | D2009/11 | B | 3/2009 |
| WO | 2006073716 | A1 | 7/2006 |
| WO | 2007110807 | A2 | 10/2007 |
| WO | WO 2007110807 | A2 * | 10/2007 |
| WO | 2010014561 | A2 | 2/2010 |
| WO | 2010068495 | A2 | 6/2010 |
| WO | 2010124190 | A2 | 10/2010 |
| WO | 2011085096 | A2 | 7/2011 |
| WO | 2012024656 | A2 | 2/2012 |

OTHER PUBLICATIONS

English translation of JP 2002-111416A, Apr. 12, 2002, Shuichi Soeda, 14 pages.*

Human translation of JP 2002-111416A, Apr. 12, 2002, 14 pages.*

International Search Report and Written Opinion for PCT application No. PCT/US2011/020368, mailed Feb. 28, 2013.

CA 139051 Examiner's Report mailed Feb. 22, 2011.

International Preliminary Report on Patentability for PCT application No. PCT/US2011/020368, mailed May 21, 2013.

U.S. Appl. No. 29/366,268 Office Action mailed Mar. 4, 2011.

U.S. Appl. No. 29/366,268 Notice of Allowance mailed May 18, 2011.

U.S. Appl. No. 29/366,268 Supplemental Notice of Allowance mailed Jun. 1, 2011.

"Operating instructions DJM-800", <http://www.pioneer.eu/eur/products/44/74/DJM-800/media.html>, retrieved Sep. 21, 2012, Jan. 1, 2005, 23 pages.

Supplementary European Search Report for European application No. 11732141.4, mailed May 30, 2014, 11 pages.

Office Action from Chinese Application No. 201180000226.6 dated Aug. 4, 2014, 10 pages.

Office Action from Japanese Application No. 2012-548120 dated Aug. 28, 2014, 9 pages.

Japanese Office Action for Japanese application No. 2012-548120, dated Apr. 28, 2014, 5 pages.

Japanese Office Action for Japanese application No. 2012-548120, dated Jan. 9, 2015, 3 pages.

Chinese Office Action for Chinese Application No. 2011800002266 dated Jun. 5, 2015, 7 pages.

Japanese Office Action for Japanese Application No. 2012-548120 dated Mar. 9, 2016, 4 pages.

* cited by examiner

DJ MIXING HEADPHONES

CROSS-REFERENCE TO RELATED APPLICATIONS

This application is a U.S. National Stage Application corresponding to PCT/US11/20368, filed on Jan. 6, 2011, entitled "DJ MIXING HEADPHONES," which is a continuation-in-part of U.S. Design patent application No. 29/366,268, filed Jul. 22, 2010, entitled "HEADPHONE BAND WITH ANGLED SHAPE," now U.S. Design patent D641,003, issued Jul. 5, 2011 and further claims the benefit of priority to U.S. Provisional Patent Application Ser. No. 61/292,832, filed on Jan. 6, 2010 entitled "DJ MIXING HEADPHONES." The content of each of the above mentioned applications is incorporated by reference in their entirety.

BACKGROUND OF THE INVENTION

1. The Field of the Invention

Implementations of the present invention relate generally to headphones. In particular, implementations of the present invention relate to headphones that can be used by a Disc Jockey ("DJ") to assist the DJ in selecting and playing music.

2. Background and Relevant Art

A DJ is a person that selects and plays music, usually for an audience. Although there are many types of DJs, one of the most popular types of a DJ is a club DJ that selects and plays recorded music for a live audience. The club DJ can select and play music in bars, nightclubs, raves, or concerts. The club DJ can provide music in an arrangement and volume that allows the audience to enjoy and dance to the music. The DJ may play recorded music from a variety of music storage mediums, including compact discs, vinyl records, cassette tapes, or computer media players.

DJs can distinguish themselves in the industry based on their unique music selection, as well as the way in which the DJ mixes music tracks together, or transitions from one song to the next. For example, several techniques used by DJs as a means to mix and blend recorded music together include: beat-matching; phrasing; slip-cueing; beat juggling; scratching; phase shifting; sampling; and harmonic mixing. Each of these techniques can allow the DJ to add a creative and unique style to the playback of recorded music.

In order to mix music tracks, the DJ may use various pieces of music equipment. For example, the DJ may use a sound system for amplification of the recordings. Additionally, the DJ may use a combination of at least two audio playing devices that are connected to the sound system. The two audio playing devices may be coupled with a DJ mixing device that allows the DJ to create a continuous playback of music by alternating from one audio playing device to the other audio playing device. This can allow the DJ to ensure that there are no gaps of silence between the completion of one music track and the beginning of another. Moreover, the DJ can use one or more of the above mentioned techniques, for example beat-matching, to create a smooth and unique transition from one music track to the next.

In addition to the musical equipment discussed above, the DJ may also use headphones. For example, the DJ may use the headphones to listen to a first music track from a first audio playing device while a second music track from a second audio playing device is playing through the sound system. Thus, the headphones allow the DJ to cue the first music track, for example, so the DJ can prepare to smoothly transition from the second music track to the first music track.

Conventional DJ headphones often include stereo over the ear headphones that include left and right speakers. Due to the fact that the DJ may listen to the first music track through the headphones and the second music track through the sound system simultaneously, the DJ may only use one of the headphone speakers. For example the DJ may hold the left speaker of the headphones against the left ear such that the left ear is listening to the first music track through the headphone speaker, while the right ear is listening to the second music track being played through the sound system. In this situation, the right speaker on the headphone may simply hang down next to the DJ's neck, or be propped-up near the top of the DJ's head.

BRIEF SUMMARY OF THE INVENTION

Implementations of the present invention comprise devices, systems, and methods, for assisting a DJ in playing and mixing recorded music. In particular, one or more implementations of the invention provide a set of mixing headphones that can selectively channel all musical components from a stereo audio signal into a single headphone speaker. The mixing headphones can include various audio control features. For example, the mixing headphones can automatically mute one of the speakers on the headphones, and at the same time, the mixing headphones can direct all of the stereo channels to the opposing speaker on the mixing headphones. The DJ can trigger the audio control features of the mixing headphones in a variety of ways, including by pressing a button located on the mixing headphones or rotating a speaker assembly on the mixing headphones.

For example, one implementation of a set of headphones can include a first speaker assembly and a second speaker assembly. The set of headphones can also include an audio control device operatively associated with one or more of the first speaker assembly and the second speaker assembly. Upon activation, the audio control device can combine and direct first and second audio signals to one of the first and second speaker assemblies, and mute the other of the first and second speaker assemblies.

Additionally, another implementation of a set of headphones can include a first speaker assembly and a second speaker assembly. Also, the set of headphones can include a mute activation mechanism positioned on the set of headphones. Furthermore, the set of headphones can include an audio control device configured to mute one or more of the first and second speaker assemblies. Articulating the mute activation mechanism to an on position can activate the audio control device to mute one or more of the first and second speaker assemblies.

Furthermore, a set of headphones can include a first speaker assembly and a second speaker assembly. The set of headphones can also include a first input jack positioned on the first speaker assembly. The first input jack can be configured to receive an audio cable. Additionally, the set of headphones can include a second input jack positioned on the second speaker assembly. The second input jack can be configured to receive an audio cable. In addition to the foregoing, the set of headphones can include one or more audio control devices configured to transmit one or more audio signals received via an audio cable secured to either the first input jack or the second input jack to both the first and second speaker assemblies.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
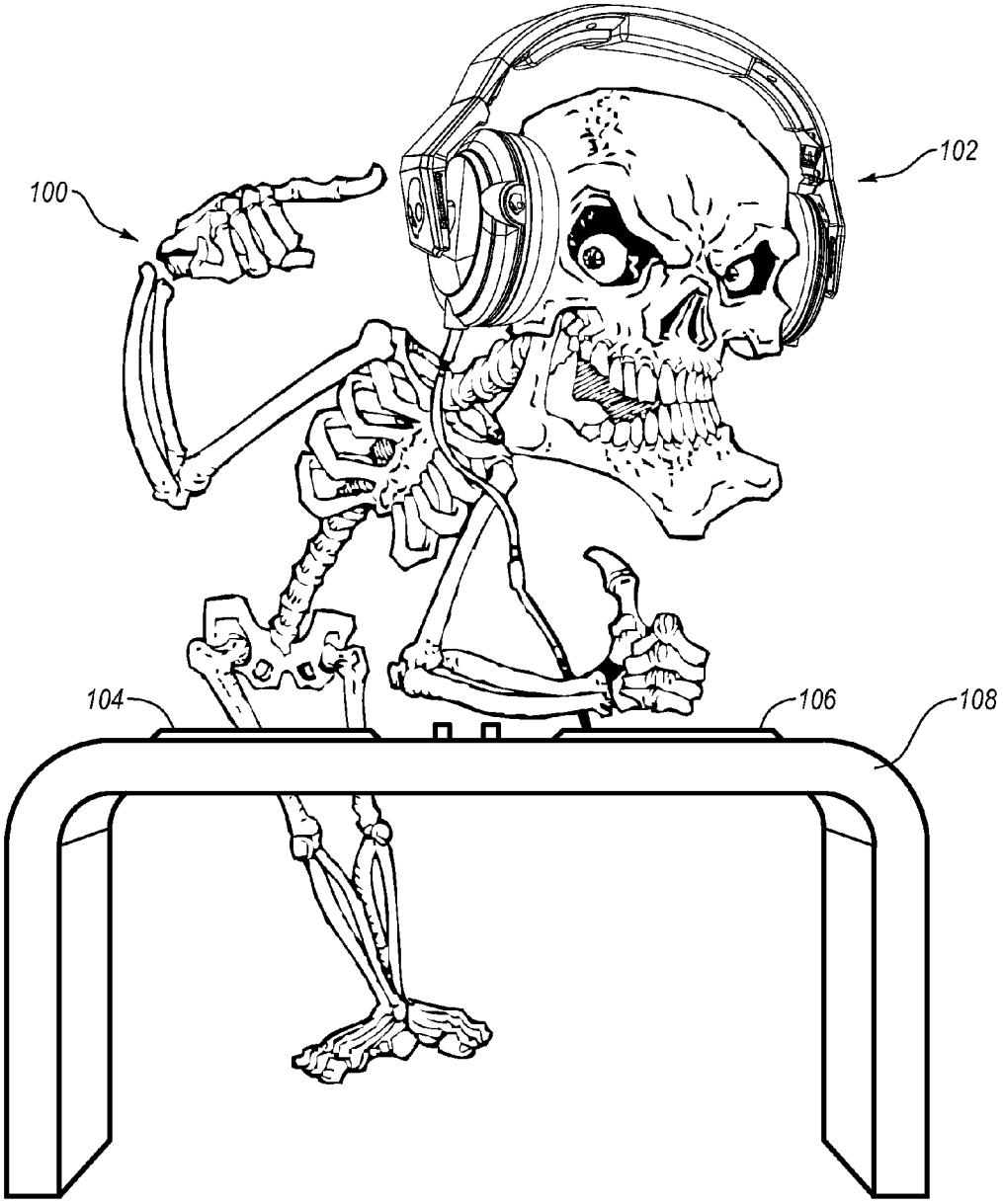
FIG. 1 illustrates an artistic rendering of a DJ using mixing headphones according to an implementation of the present invention.

Implementations of the present invention comprise devices, systems, and methods, for assisting a DJ in playing and mixing recorded music. In particular, one or more implementations of the invention provide a set of mixing headphones that can selectively channel all musical components from a stereo audio signal into a single headphone speaker. The mixing headphones can include various audio control features. For example, the mixing headphones can automatically mute one of the speakers on the headphones, and at the same time, the mixing headphones can direct all of the stereo channels to the opposing speaker on the mixing headphones. The DJ can trigger the audio control features of the mixing headphones in a variety of ways, including by pressing a button located on the mixing headphones or rotating a speaker assembly on the mixing headphones.

Additionally, one or more implementations of a set of headphones can make the mixing process more comfortable. For example, in one or more implementations the speaker assemblies can rotate in and out of a default listening position and/or be muted. Thus, a DJ using such headphones does not have to hold a single headphone speaker between the ear and the shoulder by cranking the DJ's neck toward the shoulder producing an uncomfortable stance. Moreover, the DJ does not have to hold the single headphone speaker on the ear with a hand, thus limiting the ability for the DJ to control the musical equipment. Thus, one or more implementations can allow a DJ to use both hands to control equipment during the mixing and/or transitioning of one music track to the next.

In additionally or alternatively to increasing the comfort of mixing, one or more implementations can also increase the ability to properly mix music. In particular, headphones may include left and right speakers in a stereo configuration. As recorded music often uses different stereo channels for different musical components of a single music track. Thus, a DJ listening to only one speaker of stereo headphones may not completely hear all the musical components from a particular music track.

For example, the percussion component on a music track may be directed to the right speaker, while the vocal component on the same music track is directed to the left speaker. One or more implementations of the present invention can push both components of a stereo recording to a single speaker, while muting the other speaker. One will appreciate in light of the disclosure herein that this can allow the DJ to hear both the percussion and vocal components of the music track, while at the same time listening to another music track that is being played through the sound system. Furthermore, due to the fact the DJ may listen to all the musical components of a music track through the headphones while mixing, the DJ may be able to create a high quality transition from one music track to the next. Moreover, the DJ may not have to physically switch between the right and left speakers of the headphones to acceptably mix the music track. Avoiding the need to physically switch between the left and right speakers can help avoid inadvertently making a mistake during the mixing of the music track.

Referring now to the Figures, FIG. 1 illustrates an artistic rendering of a DJ 100 using a set of headphones 102 in accordance with an implementation of the present invention. As shown the DJ 100 can use the headphones 102 to listen to music being played on an audio device (in this instance a mixing table 108). As explained in greater detail below, the DJ 100 can use the headphones 102 to listen to and mix music from a first audio playing device 104 and a second audio playing device 106 on the mixing table 108. In particular, the headphones 102 can allow the DJ 100 to create a continuous playback of music by alternating from one audio playing device 104 to the other audio playing device 106. Moreover, the DJ 100 can use one or more of the techniques, for example beat-matching, to create a smooth and unique transition from one music track to the next.

Figure 2:
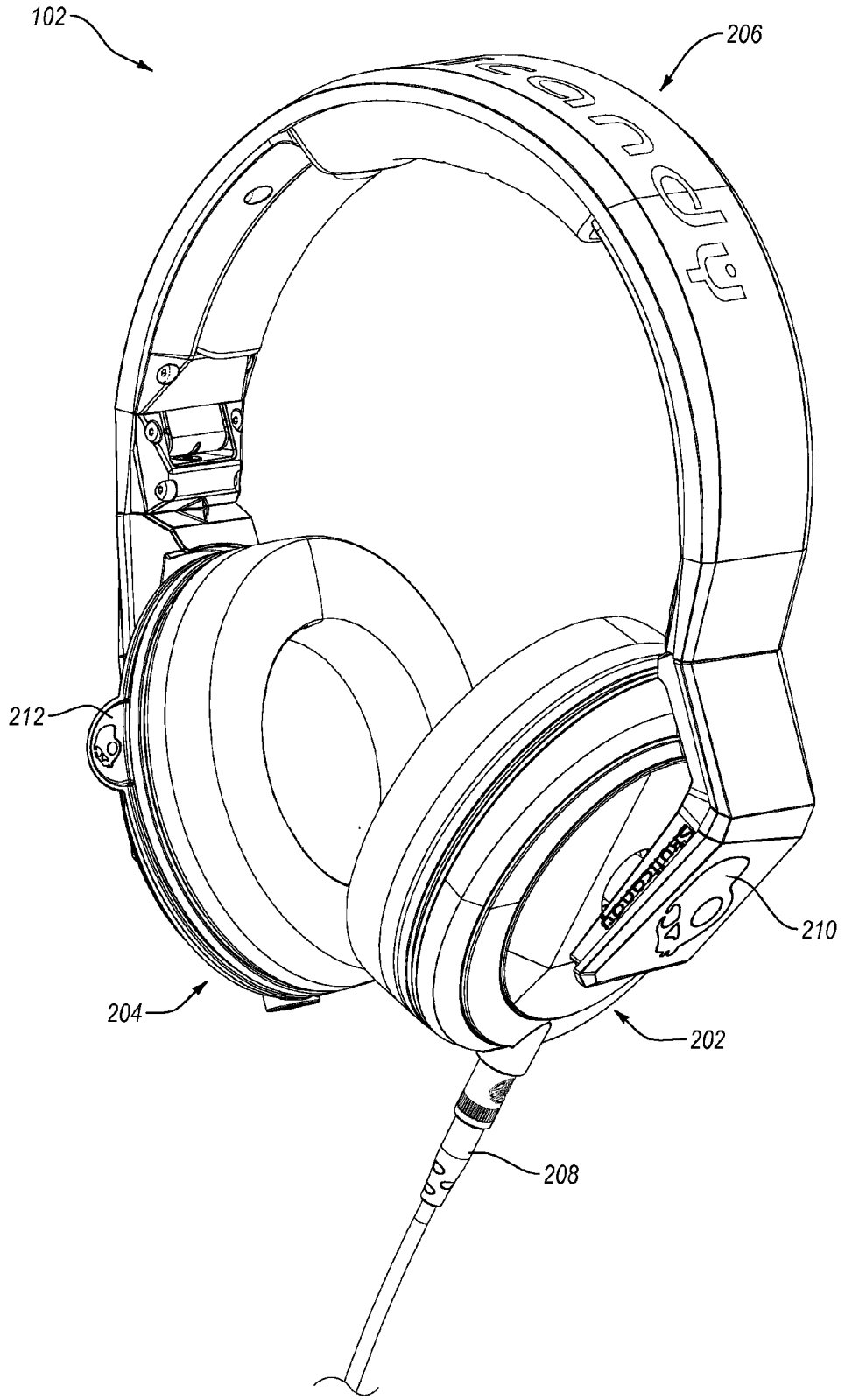
FIG. 2 illustrates a right side perspective view of the mixing headphones of FIG. 1.
Figure 3:
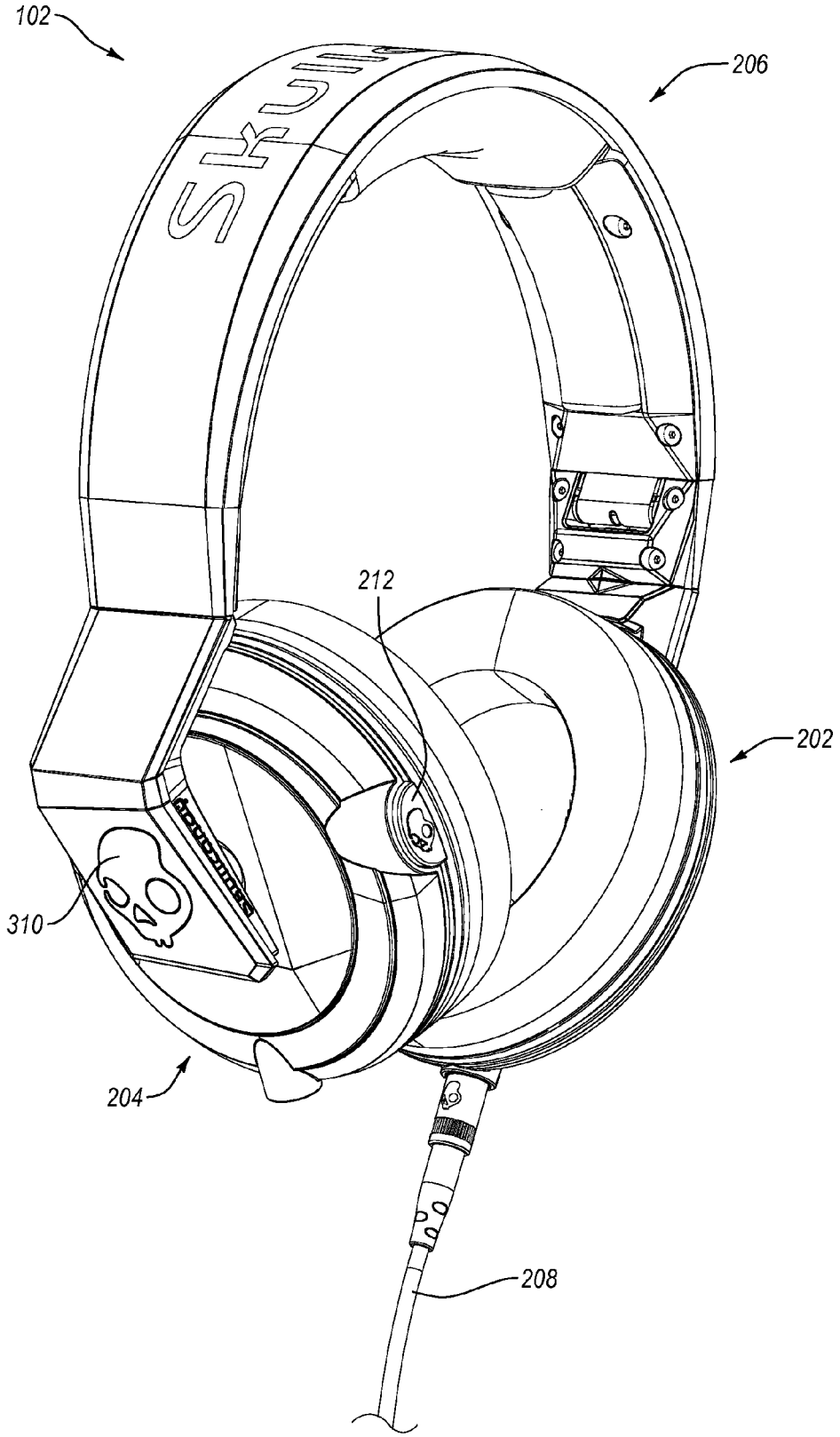
FIG. 3 illustrates a left side perspective view of the mixing headphones of FIG. 1.

FIGS. 2 and 3 and the corresponding text, describe a number of the details and features of headphones 102 in accordance with one or more implementations of the present invention. In particular, FIGS. 2 and 3 illustrates that the headphones 102 can include a first speaker assembly 202 and a second speaker assembly 204. A headband 206 can connect the first and second speaker assemblies 202, 204 together. While the headphones shown in FIGS. 1-3 and the rest of the Figures have an over-the-ear headband configuration, one will appreciate that in other implementations, the headphones 102 can have other configurations such as behind-the-neck headphones, ear buds, or any other configuration or style of headphones.

The headphones 102 can further include an audio wire 208. The audio wire 208 can connect the headphones 102 to an audio playing device, such as a mixing table 108. The audio wire 208 further can include a jack at one end of the audio cable such that the audio wire 208, and thus the headphones 102, can be connected to an audio playing device. In general, the audio playing device produces an audio signal that can be carried by the audio wire 208 to the first and second speaker assemblies 202 and 204. The first and second speaker assemblies 202 and 204 can then convert the audio signal to sound waves.

Although the headphones 102 are illustrated in FIGS. 2-3 as including an audio wire 208, other implementations of the headphones 102 can be configured to be wireless, and thus receive a wireless audio signal. For example, a wireless version of the headphones 102 may wirelessly receive an audio signal by way of an infrared signal, BLUETOOTH® signal, and/or any other wireless communication signal. The wireless capability of the headphones 102 may increase the ability for the DJ to move, dance, and control other equipment while wearing the headphones 102.

The headphones 102 further can include one or more audio control devices operatively associated with one or more of the first speaker assembly 202 and the second speaker assembly 204. The one or more audio control devices can allow the DJ to control how the audio signal is channeled to the first speaker assembly 202 and the second speaker assembly 204. For example, as explained in greater detail below, the one or more audio control devices can allow for muting, combining, and directing of the audio signals. As explained in greater detail below with reference to FIG. 8, the one or more audio control devices can comprise a printed circuit board ("PCB") or a printed wiring board (PWB) and/or one or more electrical or electromechanical switches.

In at least one implementation, the headphones 102 can include one or more audio control buttons for activating the one or more audio control devices. For example, FIGS. 2 and 3 illustrates that the headphones 102 can include a first audio control button 210 and a second audio control button 310. The audio control buttons 210 and 310 can be located on the outer cover of the speaker assemblies 202 and 204, as shown in FIGS. 2 and 3. In other implementations, the audio control buttons 210 and 310 can be positioned on various other locations of the speaker assemblies 202 and 204 or mixing headphones 102. For example, the audio control buttons 210 and 310 can be positioned on the top portion of the speaker assemblies 202 and 204, or alternatively, the audio control buttons 210 and 310 can be incorporated into the headband 206.

In addition to varying the position and location of the audio control buttons 210 and 310, the configuration of the audio control buttons 210 and 310 can have various other configurations. For example, FIGS. 2 and 3 illustrate the audio control buttons as comprising a skull logo. In alternative implementations, the audio control buttons 210 and 310 can have a substantially cylindrical configuration. In further implementations, the audio control buttons 210 and 310 can have other configurations such as square, oval, or triangular configurations. Moreover, the audio control buttons 210 and 310 can be configured to be in a shape of a graphic, logo, or other aesthetic form that distinguishes the audio control buttons 210 and 310.

Just as the configuration of the audio control buttons 210 and 310 can vary from one implementation to the next, the audio control buttons 210 and 310 can include various features. For example, the audio control buttons 210 and 310 include transparent or translucent material such that the audio control buttons 210 and 310 can incorporate a light source that is visible through the audio control buttons 210 and 310. The light source, for example, can be used to indicate the position of the audio control buttons 210 and 310. For instance, the light source can change colors or turn on and off based on whether the audio control buttons 210 and 310 are in an "ON" position or an "OFF" position. Moreover, the light source can be configured to blink or change with the beat of the music track being played through the headphones 102.

As mentioned above, the DJ can use the audio control buttons 210 and 310 to active the one or more audio control devices, which control how the audio signal is channeled to the first speaker assembly 202 and the left speaker assembly 204. For example, in one implementation the headphones 102 are configured to operate as stereo headphones, i.e., a first channel of the audio signal is played through the first or left speaker assembly 202, and a second channel of the audio signal is played through the second or right speaker assembly 204. As often is the case, the DJ 100 will need to cue or mix a first music track being played with a next or second music track. Thus, the DJ 100 may need the ability to listen to a first music track through the headphones 102, while also listening to a second music track through the sound system.

In this situation, DJ 100 can press the first audio control button 210 to the "ON" position. By so doing, the DJ 100 can activate the one or more audio control devices, which in turn can mute the first speaker assembly 202. With the first speaker assembly 202 muted, the DJ can adequately hear the second music track that is playing on the sound system. At the same time the first speaker assembly 202 is muted, the one or more audio control devices can combine the first channel of the audio signal that was being played on the first speaker assembly 202 with the second channel of the audio signal being played on the second speaker assembly 204.

The one or more audio control devices can then direct the combined or compete audio signal to the second speaker assembly 204 such that the second speaker assembly 204 plays both channels or components of the audio signal simultaneously. Specifically, the second speaker assembly 204 can effectively receive and play a mono signal based on a combination of the prior stereo signals played individually by each speaker assembly prior to the DJ 100 pressing the first audio control button 210. Furthermore, even though the first speaker assembly 202 is connected to the audio wire 208, the one or more audio control devices can combine and direct the audio signal for both the second speaker assembly 204 and the first speaker assembly 202 to the second speaker assembly 204.

Thus, the or more audio control devices can be activated by the audio control buttons 210 and 310 of the headphones 102 to provide a seamless tool for the DJ 100 to mix and/or transition from one music track to another. In particular, with just a touch of a button, the DJ 100 can mute the first speaker assembly 202, allowing the DJ 100 to hear the music track playing through the sound system. Moreover, the audio signal for the first speaker assembly 202 is not lost, as with conventional headphones and techniques. In contrast, the audio signal for the first speaker assembly 202 is automatically combined with the audio signal for the second speaker assembly 204. Once combined, the one or more audio control devices direct the audio signal to the second speaker assembly 204. Thus, allowing the DJ 100 to hear all the musical components in the music track. By so doing, one or more implementations enable the DJ 100 to use both hands and stand in a comfortable stance while mixing music tracks.

Thus, the headphones 102 can avoid the need for the DJ 100 to hold the mixing headphones with a hand, or crank the DJ's neck to hold the headphones between the DJ's ear and shoulder in an awkward and uncomfortable stance.

Similar to the first audio control button 210, the second audio control button 310 can activate and deactivate the one or more audio control devices. When the second audio control button 310 activates the one or more audio control devices; however, the one or more audio control devices can mute the second speaker assembly 204 and push the complete or combined audio signal to the first speaker assembly 202. Thus, a right-handed DJ, for example, can press the second audio control button 310 to the "ON" position to activate the one or more audio control devices.

Once activated by the second audio control button 310, the one or more audio control devices can mute the second speaker assembly 204. Additionally, the one or more audio control devices can also combine the audio signal intended for the second speaker assembly 204 with the audio signal for the first speaker assembly 202 and directed the combined audio signal to the first speaker assembly 202. Thus, one or more implementations of the present invention can allow the DJ 100 to mute either the first or the second speaker assembly 202, 204, while sending a complete or combined audio signal to the other of the first and second speaker assembly 202, 204.

Moreover, in one or more implementations the one or more audio control devices headphones 102 can mute both the first and second speaker assemblies. With both the left speaker assembly 202 and the right speaker assembly 204 muted, the DJ 100 can concentrate on the music track(s) being played on the sound system, or the reaction of the audience. For example, in one or more implementations the one or more audio control devices to mute both the first and the second speaker assemblies 202, 204 when both the left audio control button 210 and the right audio control button 310 are in the "ON" position. Additionally or alternatively, the headphones 100 can include a mute button 212 as shown in FIGS. 2 and 3. Upon pressing of the mute button 212, the one or more audio control devices can mute both the left speaker assembly 202 and the right speaker assembly 204.

FIGS. 2 and 3 illustrate that the mute button 212 is positioned on the second speaker assembly 204. In alternative implementations, the mute button 212 can be positioned on the right speaker assembly 204 or the headband 206. In yet further implementations, both the first speaker assembly 202 and the second speaker assembly 204 can include a mute button 212. In any event, one or more implementations of the present invention can allow the DJ 100 to mute selectively mute one or both of the first and second speaker assemblies 202, 204 of the headphones 102.

In one or more additional implementations, the headphones 102 can include one or more mechanisms other than the audio control buttons 210 and 310 for activating and deactivating the one or more audio control devices. For example, in one or more implementations the headphones 102 can include one or more pivots that allow the first and second speaker assemblies 202, 204 to rotate away from a default listening position (see FIGS. 1-3). As used herein, the term "default listening position" refers to a position of a speaker assembly that allows a user to listen to the speaker assembly when wearing the headphones 102 (see FIGS. 1-3). Along with the one or more pivots, the headphones 102 can include a rotation switch that is configured to activate the one or more audio control devices upon rotation of a speaker assembly. Thus, according to one or more implementations, the DJ 100 can rotate either the first or second speaker assembly 202, 204 from a default listening position (see FIGS. 1-3) to an activated position to activate the one or more audio control devices.

Figure 4:
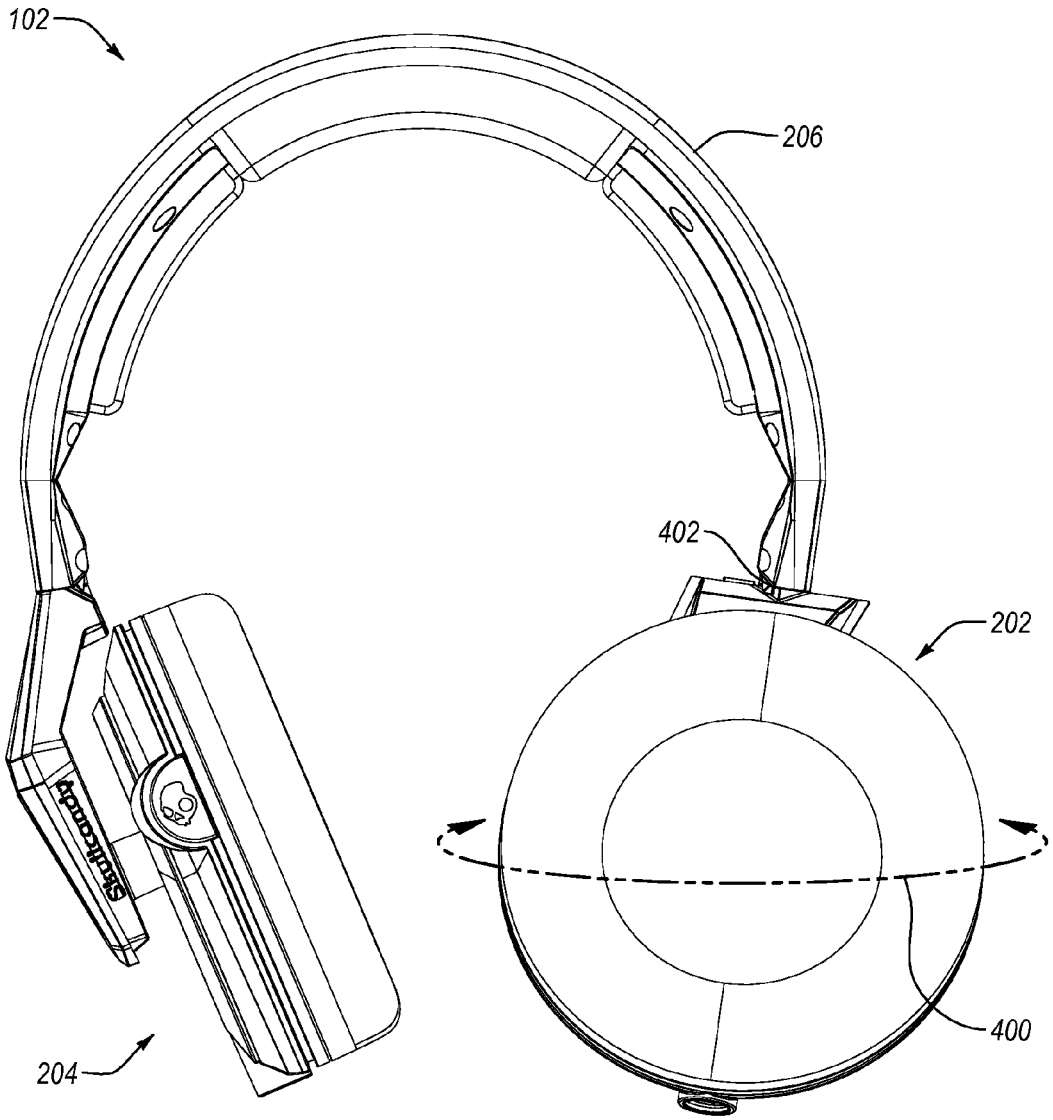
FIG. 4 illustrates a front view of the mixing headphones of FIG. 1 in which the right speaker is rotated out of a default listening position.

For example, FIG. 4 illustrates that the headphones 102 include a pivot 402 and associated rotation switch. The pivot 402 can rotatably couple the first speaker assembly 202 to the headband 206. The pivot 402 can allow the first speaker assembly 202 to rotate from a default listening position as shown in FIGS. 1-3 to an activated position as shown in FIG. 4. In particular, the pivot 402 can allow the first speaker assembly 202 to rotation in a direction 400 about an axis extending from the top of the first speaker assembly to the bottom of the first speaker assembly 202.

In particular, rotation switches can include a hinged connection, or similar connection, that allows the speaker assemblies 202 and 204 to rotate with respect to the headband 206. In addition, the rotation switches can include one or more sensing components that detect when the speaker assemblies 202 and 204 are rotated to a particular position with respect to the headband 206. For example, the rotation switches can include various electromechanical contact switches that are brought in and out of contact as the DJ 100 rotates the speaker assemblies 202 and 204. Alternatively, other similar types of switches or sensors can be used to detect the position of the speaker assemblies 202 and 204 with respect to the headband 206.

One will appreciate, in light of the disclosure herein, that the rotation switch associated with the pivot 402 can activate the one or more audio control devices based upon a predetermined amount of rotation of the first speaker assembly 202. In one or more implementations, the rotation switch can activate the one or more audio control devices upon 90 degrees of rotation of the first speaker assembly 202. In other implementations, the rotation switch can activate the one or more audio control devices upon 45 degrees or 180 degrees of rotation of the first speaker assembly 202, or another desired degree of rotation.

In any event, a DJ 100 can control how the audio signals are directed to the speaker assemblies 202, 204 by rotating one of the speaker assemblies 202, 204. For instance, the DJ 100 can rotate the first speaker assembly 202 about the pivot 402 in a direction 400 from a default listening position to an activated position as shown by FIG. 4. By so doing, the DJ 100 can activate the one or more audio control devices, which in turn can mute the first speaker assembly 202. At the same time the first speaker assembly 202 is muted, the one or more audio control devices can combine the first channel of the audio signal that was being played on the first speaker assembly 202 with the second channel of the audio signal being played on the second speaker assembly 204. The one or more audio control devices can then direct the combined or compete audio signal to the second speaker assembly 204 such that the second speaker assembly 204 plays both channels or components of the audio signal simultaneously. Specifically, the second speaker assembly 204 can effectively receive and play a mono signal based on a combination of the prior stereo signals played individually by each speaker assembly prior to the DJ 100 pressing the first audio control button 210.

Thus, the or more audio control devices can be activated by rotation of the speaker assemblies 202, 204 of the headphones 102 to provide a seamless tool for the DJ 100 to mix and/or transition from one music track to another. In particular, the DJ 100 can rotate a speaker assembly 202, 204 away from his ear to allow him to hear the crowd or audio being played by a sound system. At the same time, the one or more audio control devices can mute the rotated speaker assembly further allowing the DJ 100 to hear the music track playing through the sound system. Moreover, as described above, the audio signal for the first speaker assembly 202 is not lost, as with conventional headphones and techniques. In contrast, the audio signal for the first speaker assembly 202 is automatically combined with the audio signal for the second speaker assembly 204, and directed to the second speaker assembly 204.

Similar to the pivot 402 and associated rotation switch, the headphones 102 can include a second pivot and associated rotation switch positioned between the second speaker assembly 204 and the headband 206. The second pivot and associated rotation switch can activate and deactivate the one or more audio control devices. When a DJ 100 rotates the second speaker assembly 204 about the second pivot, the associated rotation switch can activate the one or more audio control devices. Upon activation by rotation of the second speaker assembly 204, the one or more audio control devices can mute the second speaker assembly 204 and push the complete or combined audio signal to the first speaker assembly 202. Thus, a right-handed DJ, for example, can rotate the second speaker assembly to activate the one or more audio control devices.

Once activated by rotation of the second speaker assembly 204, the one or more audio control devices can mute the second speaker assembly 204. Additionally, the one or more audio control devices can also combine the audio signal intended for the second speaker assembly 204 with the audio signal for the first speaker assembly 202 and directed the combined audio signal to the first speaker assembly 202. Thus, one or more implementations of the present invention can allow the DJ 100 to mute either the first or the second speaker assembly 202, 204, while sending a complete or combined audio signal to the other of the first and second speaker assembly 202, 204.

While FIG. 4 and the associated text describes that a DJ 100 can rotate either the first or second speaker assemblies 202, 204 about an axis extending from the top to the bottom of the speaker assembly to activate the one or more audio control devices, the present invention is not so limited. Indeed, the pivots connecting the speaker assemblies 202, 204 to the headband 208 can allow the speaker assemblies 202, 204 to rotate in any number of directions to activate the one or more audio control devices. For example, the headphones 102 can include pivots that allow the speaker assemblies to rotate outward away a user's ear. Alternatively, headphones 102 can include pivots that allow the speaker assemblies to rotate backward or forward away from a user's ear. In any event, rotation of either the first speaker assembly 202 or the second speaker assembly 204 away from the default listening position can activate the one or more audio control devices in a manner similar to that described herein above in relation to FIG. 4.

In further implementations of the present invention, rotation of the first or second speaker assemblies 202, 204 out of a default listening position may not mute the rotated speaker assembly. The mere rotation of the speaker assembly 202, 204 away from the ear of the DJ 100 can allow the DJ 100 to hear the audience or audio being played over a sound system. In such implementations, the mute button 212 can activate the one or more audio control devices to mute the rotate speaker assembly. Thus, the DJ 100 can choose to rotate a speaker assembly 202, 204 away from his ear with or without muting the rotated speaker assembly 202, 204.

Figure 5:
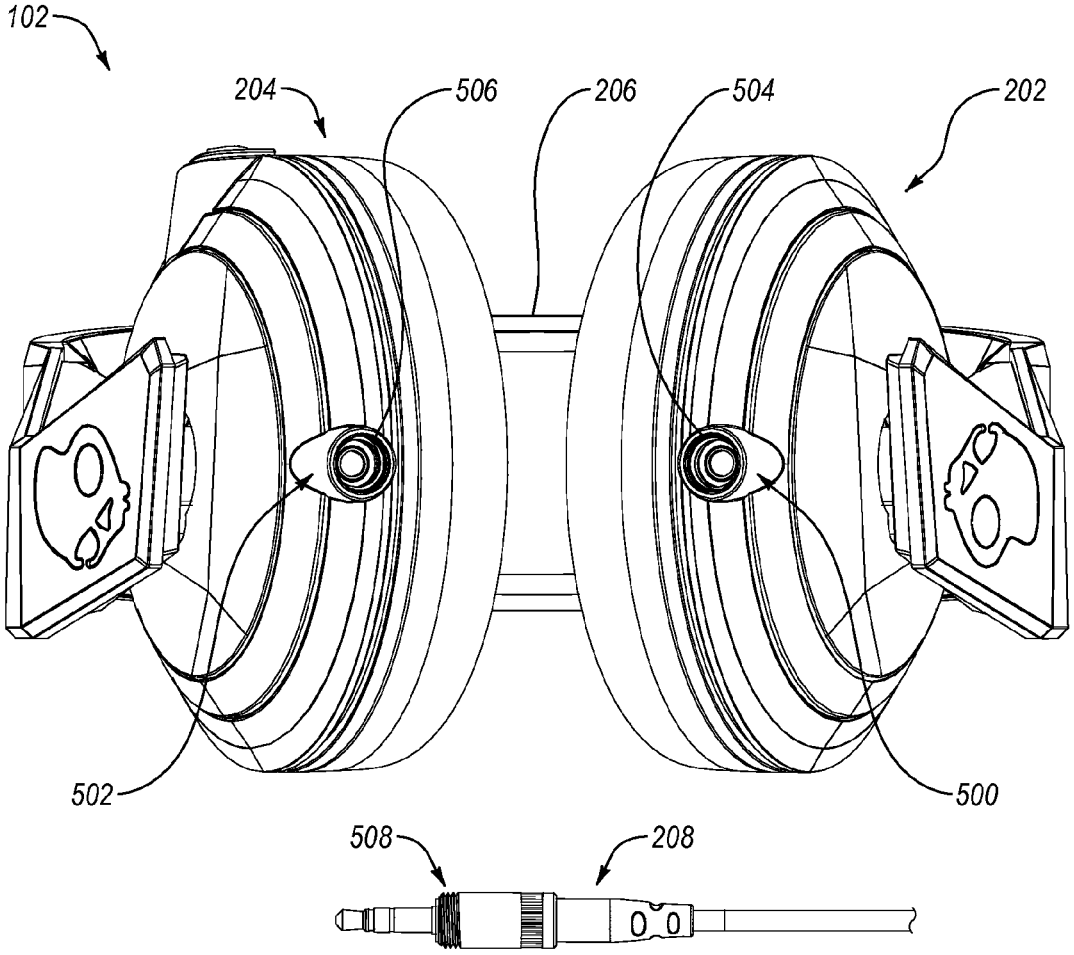
FIG. 5 is a bottom view of the mixing headphones of FIG. 1.

As alluded to earlier, the headphones 102 can allow a DJ 100 to connect an audio cable 208 to either the first speaker assembly 202 or the second speaker assembly 204. For example, FIG. 5 illustrates a bottom view of the headphones 102. As shown by FIG. 5, the first speaker assembly 202 can include a first input jack 500 and the second speaker assembly 204 can include a second input jack 502. Both the first input jack 500 and the second input jack 502 can selectively receive an audio cable 208. Thus, a DJ 100 can selectively choose to secure the audio cable 208 to either input jack 500, 502. Thus, a DJ 100 can choose to run the audio cable 208 from the first speaker assembly 202 or the second speaker assembly 204. The dual input jacks 500, 502 can ensure that the audio cable 208 is out of the way for either a left-handed or right-handed DJ 100.

Furthermore, the headphones 102 can include one or more audio control devices associated with the first and second input jacks 500, 502. The one or more audio control devices can allow the first input jack 500 to transmit one or more signals received via an audio cable 208 secured thereto to both the first and second speaker assemblies 202, 204. Similarly, the one or more audio control devices can allow the second input jack 502 can transmit one or more signals received via an audio cable 208 secured thereto to both the first and second speaker assemblies 202, 204.

More specifically, the audio cable 208 can transmit a stereo audio signal to the first input jack 500. The one or more audio control devices can send a first channel of the stereo audio signal to the first speaker assembly 202 and a second channel of the stereo audio signal to the second speaker assembly 204. Along similar lines, when the audio cable 208 is connected to the second input jack 502. The one or more audio control devices send a first channel of the stereo audio signal to the first speaker assembly 202 and a second channel of the stereo audio signal to the second speaker assembly 204.

In addition to the foregoing, the headphones 102 can include a locking mechanism configured to prevent the audio cable 208 from unintentionally releasing from the selected input jack 500, 502. For example, each input jack 500, 502 can include internal threads 504, 506. The internal threads 504, 506 can mate with external threads 508 on the audio cable 208 thereby locking the audio cable 208 to the headphones 208. In alternative implementations, the audio cable 208 can lock to an input jack 500, 502 via a snap-fit engagement or other locking mechanism.

Figure 6:
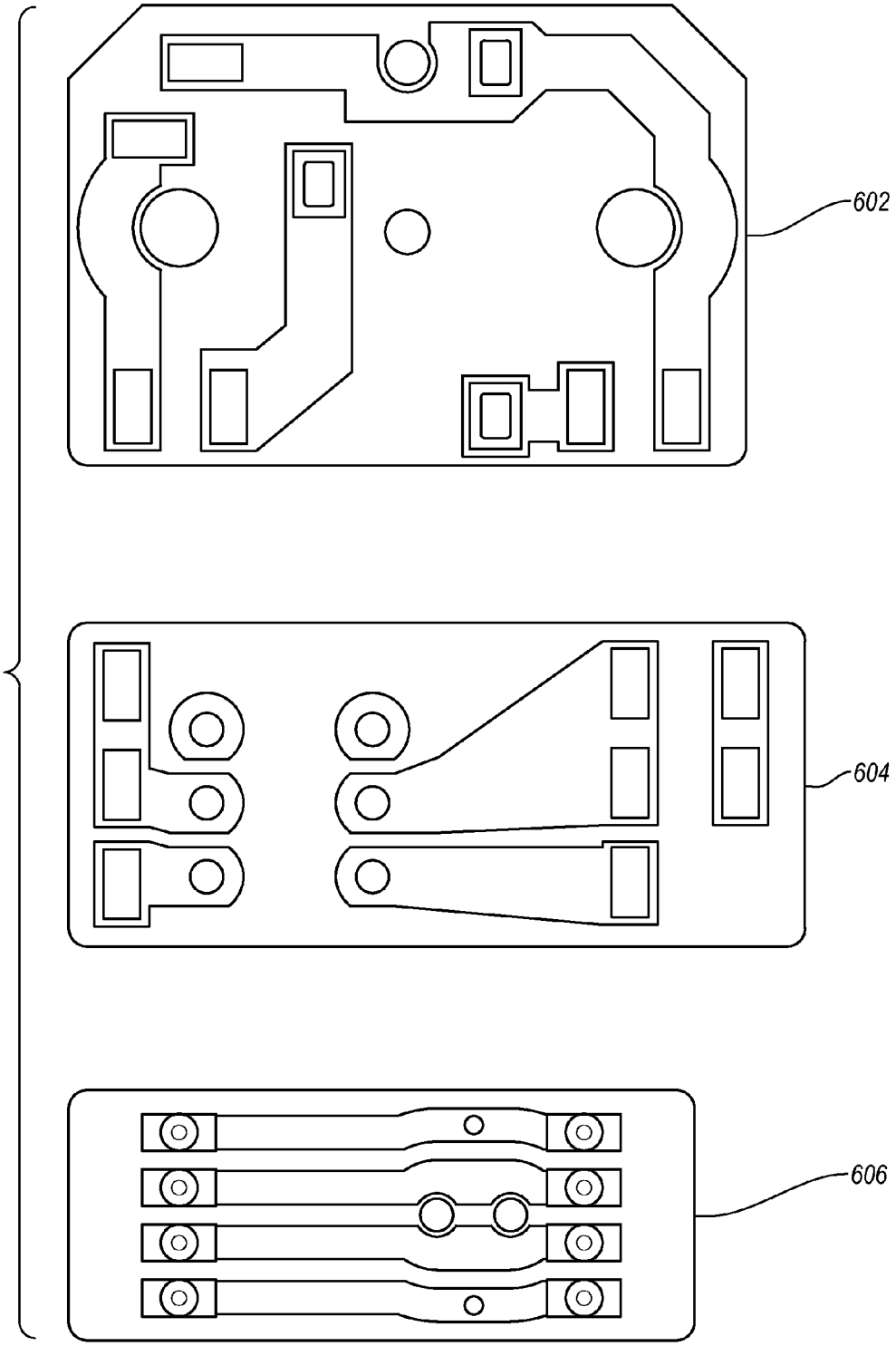
FIG. 6 illustrates top views of various audio control devices.

As discussed herein above, the headphones 102 can include one or more audio control devices that allow a DJ 100 or other user to control muting, transferring, and combining of audio signals. The one or more audio control devices can include a printed circuit board ("PCB") or a printed wiring board (PWB) and/or one or more electrical or electromechanical switches. For example, FIG. 6 illustrates various PWBs that can function as audio control devices as described hereinabove.

For example, the one or more audio control devices can include one or more jack PWBs 602. In particular, in one or more implementations the headphones 102 can include a first jack PWB 602 positioned within the first speaker assembly 202 and a second jack PWB 602 positioned within the second speaker assembly 204. As described hereinabove, the jack PWBs 602 can receive and transmit audio signals received from the audio cable 208. The jack PWBs 602 can each be associated with an input jack 500, 502.

The one or more audio control devices can also include one or more mute PWBs 604. In particular, in one or more implementations the headphones 102 can include a mute PWB 604 associated with each mute button 212. Thus, in at least one implementation the headphones 102 illustrated in FIGS. 1-3 can include a single mute PWB 604. In alternative implementations, the headphones 102 can include two mute buttons 212, one on each speaker assembly 202, 204, and thus, two mute PWBs 604. In any event, the mute PWB 604, when activated can mute one or more of the speaker assemblies 202, 204.

The one or more audio control devices can also include one or more mono PWBs 606. In particular, in one or more implementations the headphones 102 can include a first mono PWB 606 associated with the first speaker assembly 202 and a second mono PWB 606 associated with the second speaker assembly 204. The mono PWBs 606 can combine two stereo channels into a signal mono audio signal and transfer the mono signal to a single speaker assembly and/or mute the other speaker assembly 202, 204. Thus, in at least one implementation of the present invention, the one or more audio control devices can include five PWBs. In particular, two jack PWBs 602, one mute PWB 604, and two mono PWBs 606.

Figure 7:
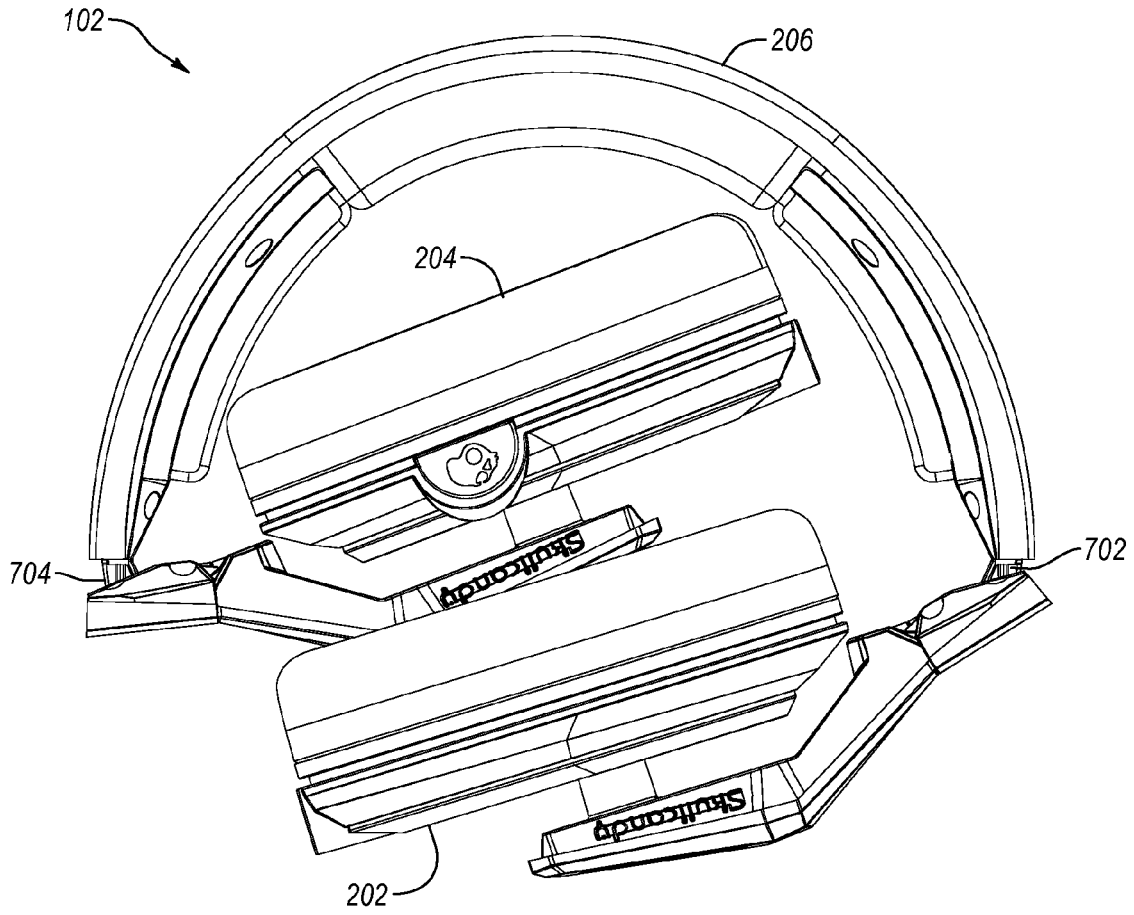
FIG. 7 is a front view of the mixing headphones of FIG. 1, albeit in a folded configuration.

In addition to the foregoing features and benefits, the headphones 102 can also include one or more folding pivots that allow for easy folding of the headphones 102 into a compact storage configuration. For example, FIG. 7 illustrates that the headphones 102 can include a first folding pivot 702 connecting the first speaker assembly 202 to the headband 206. FIG. 7 also illustrates that the headphones 102 can include a second folding pivot 704 connecting the second speaker assembly 204 to the headband 206. In at least one implementation, the folding pivots 702, 704 and/or pivots 402 can be a single mechanism such that a single pivot can allow for folding of the headphones 102 into a compact position, and rotating of a speaker assembly from a default listening position.

The present invention thus can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A set of disc jockey (DJ) headphones configured to allow a user to control how stereo audio signals are directed to speaker assemblies within the headphones, comprising:

a headband;

a first speaker assembly coupled to a first side of the headband and comprising a pivot enabling the first speaker assembly to rotate relative to the headband in and out of a default listening position in a direction about an axis extending from the top of the first speaker assembly to the bottom of the first speaker assembly;

a second speaker assembly coupled to a second side of the headband and comprising a second pivot enabling the second speaker assembly to rotate relative to the headband in and out of a default listening position in a direction about an axis extending from the top of the second speaker assembly to the bottom of the second speaker assembly; and at least one audio control device operatively associated with the first speaker assembly and the second speaker assembly;

a rotation switch positioned on the first speaker assembly and being configured to activate and deactivate the at least one audio control device, wherein rotating the first speaker assembly out of the default listening position is configured to actuate the rotation switch and activate the at least one audio control device and rotation of the first speaker assembly into the default listening position is configured to deactivate the rotation switch and the at least one audio control device;

another rotation switch on the second speaker assembly and being configured to activate and deactivate the at least one audio control device, wherein rotating the second speaker assembly out of the default listening position is configured to actuate the another rotation switch and activate the at least one audio control device and rotation of the second speaker assembly into the default listening position is configured to deactivate the another rotation switch and the at least one audio control device;

a mute button positioned on one of the first speaker assembly and the second speaker assembly, wherein, upon activation of the mute button, both the first speaker assembly and the second speaker assembly are muted;

a first folding pivot connecting the first speaker assembly to the headband, the first folding pivot configured to enable the first speaker assembly to rotate in a direction toward the headband about another axis transverse to the axis extending from the top of the first speaker assembly to the bottom of the first speaker assembly; and a second folding pivot connecting the second speaker assembly to the headband, the second folding enable the second speaker assembly to rotate in a direction toward the headband about another axis transverse to the axis extending from the top of the second speaker assembly to the bottom of the second speaker assembly;

wherein upon activation of the at least one audio control device by a disc jockey wearing the set of disc jockey headphones by rotating the first speaker assembly out of the default listening position and actuating the rotation switch, the audio control device is configured to combine and direct first and second audio signals to the second speaker assembly, and mute the first speaker assembly; and wherein upon activation of the at least one audio control device by the disc jockey wearing the set of disc jockey headphones by rotating the second speaker assembly out of the default listening position and actuating the another rotation switch, the at least one audio control device is configured to combine and direct the first and second audio signals to the first speaker assembly and mute the second speaker assembly.

2. The set of headphones of claim 1, wherein the audio control device comprises one or more printed wiring boards.

3. The set of headphones of claim 1, further comprising:

a first input jack positioned on the first speaker assembly, the first input jack being configured to receive an audio cable;

a second input jack positioned on the second speaker assembly the second input jack being configured to receive an audio cable; and one or more additional audio control devices configured to transmit one or more audio signals received via an audio cable secured to either the first input jack or the second input jack to both the first and second speaker assemblies.

4. The set of headphones of claim 3, wherein:

the one or more audio signals comprise a two channel stereo signal;

the one or more additional audio control devices are configured to transmit a first audio signal of the two channel stereo signal to the first speaker assembly; and the one or more additional audio control devices are configured to transmit a second audio signal of the two channel stereo signal to the second speaker assembly.

5. The set of headphones of claim 3, further comprising a locking mechanism configured to prevent the audio cable from unintentionally releasing from the first input jack.

6. The set of headphones of claim 5, wherein the locking mechanism comprises an internally threaded receptacle configured to mate with external threads on the audio cable.

7. A set of disc jockey (DJ) headphones configured to allow a user to control how audio signals are directed to speaker assemblies within the headphones, comprising:

a headband;

a first speaker assembly coupled to a first side of the headband;

a first pivot configured to allow the first speaker assembly to rotate in and out of a default listening position in a direction about an axis extending from the top of the first speaker assembly to the bottom of the first speaker assembly;

a second speaker assembly coupled to a second side of the headband;

a first folding pivot connecting the first speaker assembly to the headband, the first folding pivot configured to enable the first speaker assembly to rotate in a direction toward the headband;

a second folding pivot connecting the second speaker assembly to the headband, the second folding pivot configured to enable the second speaker assembly to rotate in a direction toward the headband;

an audio control device configured to, in a default state, direct a first audio signal to only the first speaker assembly and a second audio signal to only the second speaker assembly; and a single activation mechanism positioned on the first speaker assembly and configured to control the audio control device in order to simultaneously combine and direct both of the first audio signal and the second audio signal to the second speaker assembly and mute the first speaker assembly, wherein the single activation mechanism is configured to be activated upon rotation of the first speaker assembly out of the default listening position by a disc jockey wearing the set of disc jockey headphones.

8. The set of headphones of claim 7, further comprising a mute activation mechanism positioned on the set of headphones, wherein articulating the mute activation mechanism to an on position activates the audio control device to mute both of the first and second speaker assemblies.

9. The set of headphones of claim 7, wherein:

articulating the single activation mechanism to an on position activates the audio control device to:

mute the first speaker assembly; and transmit the first audio signal and the second audio signal of a stereo audio signal to the second speaker assembly; and the set of headphones further comprises another single activation mechanism configured to activate the audio control device in order to simultaneously combine and direct the first audio signal and the second audio signal of the stereo audio signal to the first speaker assembly and mute the second speaker assembly.

10. A set of headphones configured to allow a user to control how stereo audio signals are directed to speaker assemblies within the headphones, comprising:

a headband;

a first speaker assembly movable from a default listening position to a displaced position in a direction about an axis extending from the top of the first speaker assembly to the bottom of the first speaker assembly;

a second speaker assembly;

a first folding pivot coupling the first speaker assembly to the headband, the first folding pivot configured to enable the first speaker assembly to rotate in a direction toward the headband;

a second folding pivot coupling the second speaker assembly to the headband, the second folding pivot configured to enable the second speaker assembly to rotate in a direction toward the headband;

an audio control device operatively associated with and positioned on one or more of the first speaker assembly and the second speaker assembly, the audio control device configured to, in a first state, direct a first audio signal to only the first speaker assembly and a second audio signal to only the second speaker assembly, the audio control device configured to, in a second state, combine and direct the first audio signal and the second audio signal to one of the first speaker assembly and the second speaker assembly and mute the other of the first speaker assembly and the second speaker assembly; and a switch configured to control the audio control device between the first state and the second state, wherein movement of the first speaker assembly from the default listening position to the displaced position physically actuates the switch in order to place the audio control device in the second state and combine and direct the first audio signal and the second audio signal to the second speaker assembly and mute the first speaker assembly, and wherein movement of the first speaker assembly from the displaced position to the default listening position physically actuates the switch in order to place the audio control device in the first state and direct the first audio signal to only the first speaker assembly and the second audio signal to only the second speaker assembly.

11. The set of headphones of claim 10, further comprising a mute button positioned on one of the first speaker assembly and the second speaker assembly, the mute button configured to mute both the first speaker assembly and the second speaker assembly upon activation of the mute button.

12. The set of headphones of claim 10, further comprising another switch configured to control the audio control device, wherein moving the second speaker assembly from a default listening position to a displaced position physically actuates the another switch in order to combine and direct the first audio signal and the second audio signal to the first speaker assembly and mute the second speaker assembly.

* * * * *